US011286868B2

(12) United States Patent
Oh et al.

(10) Patent No.: US 11,286,868 B2
(45) Date of Patent: Mar. 29, 2022

(54) METHOD OF COMPENSATING FUEL FOR EACH CYLINDER OF AN ENGINE DURING PURGING

(71) Applicants: Hyundai Motor Company, Seoul (KR); Kia Motors Corporation, Seoul (KR)

(72) Inventors: Young-Kyu Oh, Gwacheon-Si (KR); Keum-Jin Park, Anyang-Si (KR); Se-Geun Kim, Yongin-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 111 days.

(21) Appl. No.: 16/735,492

(22) Filed: Jan. 6, 2020

(65) Prior Publication Data

US 2020/0392913 A1 Dec. 17, 2020

(30) Foreign Application Priority Data

Jun. 11, 2019 (KR) ..... 10-2019-0068851

(51) Int. Cl.
*F02D 41/00* (2006.01)
*F02D 41/30* (2006.01)

(52) U.S. Cl.
CPC ..... *F02D 41/0032* (2013.01); *F02D 41/008* (2013.01); *F02D 41/0045* (2013.01); *F02D 41/3005* (2013.01)

(58) Field of Classification Search
CPC ..... F02D 41/0032; F02D 41/3005; F02D 41/008; F02D 41/0045; F02D 41/18; F02D 41/0042; F02D 41/004; F02D 41/40; F02D 41/2467; F02D 2200/0402; F02D 2200/0406
See application file for complete search history.

(56) References Cited

U.S. PATENT DOCUMENTS

| | | | | |
|---|---|---|---|---|
| 6,230,699 | B1 * | 5/2001 | Mitsutani | F02D 41/0042 123/674 |
| 10,480,431 | B1 * | 11/2019 | Dudar | F02M 25/0854 |
| 10,495,018 | B2 * | 12/2019 | Kim | F02D 41/2467 |
| 11,002,201 | B1 * | 5/2021 | Oh | G01F 1/76 |
| 11,035,311 | B2 * | 6/2021 | Oh | F02D 9/08 |

(Continued)

FOREIGN PATENT DOCUMENTS

| | | | |
|---|---|---|---|
| KR | 10-2016-0011585 | A | 2/2016 |
| KR | 10-2018-0067335 | A | 6/2018 |
| KR | 10-2019-0020797 | A | 3/2019 |

*Primary Examiner* — Phutthiwat Wongwian
*Assistant Examiner* — Sherman D Manley
(74) *Attorney, Agent, or Firm* — Morgan, Lewis & Bockius LLP

(57) ABSTRACT

A method of compensating fuel for each cylinder of an engine during purging may include, compensating a fuel injection time for each cylinder depending on an amount of intake air for each cylinder, an injection pressure of the injector, and an internal pressure of a combustion chamber of the engine; pressurizing a vaporized gas adsorbed into a canister and injecting the pressurized vaporized gas into the intake pipe by operating an active purge pump; and estimating an amount of vaporized gas reaching each combustion chamber and converting the fuel injection time depending on the estimated amount of vaporized gas.

12 Claims, 6 Drawing Sheets

(56) References Cited

U.S. PATENT DOCUMENTS

| | | | | |
|---|---|---|---|---|
| 2002/0066440 | A1* | 6/2002 | Kano | F02M 25/089 123/520 |
| 2002/0129797 | A1* | 9/2002 | Hayashi | F02D 41/0032 123/520 |
| 2002/0162457 | A1* | 11/2002 | Hyodo | B01D 53/0454 96/109 |
| 2005/0274353 | A1* | 12/2005 | Okubo | F02M 63/029 123/299 |
| 2010/0294431 | A1* | 11/2010 | Maquin | H01L 21/67017 156/345.26 |
| 2015/0075502 | A1* | 3/2015 | Surnilla | F02M 25/08 123/520 |
| 2015/0075503 | A1* | 3/2015 | Surnilla | F02D 41/123 123/520 |
| 2017/0096974 | A1* | 4/2017 | Dudar | B60W 20/00 |
| 2018/0306131 | A1* | 10/2018 | Tsuda | F02D 41/40 |
| 2019/0249581 | A1* | 8/2019 | Wodausch | F01N 3/035 |
| 2019/0353112 | A1* | 11/2019 | Kim | F02D 41/0042 |
| 2019/0360434 | A1* | 11/2019 | Dudar | F02D 41/0032 |
| 2020/0032724 | A1* | 1/2020 | Asanuma | F02D 41/40 |

* cited by examiner

METHOD OF COMPENSATING FUEL FOR EACH CYLINDER OF AN ENGINE DURING PURGING

CROSS-REFERENCE(S) TO RELATED APPLICATIONS

The present application claims priority to Korean Patent Application No. 10-2019-0068851, filed on Jun. 11, 2019, the entire contents of which is incorporated herein for all purposes by this reference.

BACKGROUND OF THE PRESENT INVENTION

Field of the Invention

The present invention relates to a method of compensating fuel for each cylinder of an engine during purging, and more particularly, to a method of compensating fuel for each cylinder of an engine during purging by differentially applying a fuel injection amount to each cylinder.

Description of Related Art

An exhaust gas recirculation (EGR) apparatus as a nitrogen oxide reduction device is mounted in a vehicle. The combustion heat is reduced by recirculating exhaust gas from an exhaust pipe to an intake pipe to reduce the generation of nitrogen oxides.

As shown in FIG. 1, when an opening amount of a throttle valve 1 is small, an exhaust gas recirculation (EGR) gas G2 is mixed with an intake air G1 in a surge tank 2 and then moves to each combustion chamber. However, as shown in FIG. 2, when the opening amount of the throttle valve 1 connected to the surge tank 2 is large, the EGR gas G2 is not mixed with the intake air G1 in the surge tank 2, and intensively moves to a specific combustion chamber.

As shown in FIG. 1, when the opening amount of the throttle valve 1 is small, a vortex is generated on a back surface of the throttle valve 1 to make the intake air G1 reflow from the surge tank 2 toward the throttle valve 1. The reflowing intake air collides on one surface of the throttle valve 1 and then is introduced into the surge tank 2 again in a state in which the reflowing intake air is mixed with an intake air newly introduced along internal an internal side surface of the intake pipe 3. The EGR gas G2 also reflows from the surge tank 2 toward the throttle valve 1 by the vortex generated on the back surface of the throttle valve 1 and then is introduced into the surge tank 2 again in a state where the EGR gas G2 is mixed with the intake air G1 newly introduced along the internal side surface of the intake pipe 3. Therefore, the EGR gas G2 is easily mixed with the intake air G1.

However, as shown in FIG. 2, when the opening amount of the throttle valve 1 is large, the vortex is little generated on the back surface of the throttle valve 1. Therefore, it is difficult for the intake air to reflow from the surge tank 2 to the throttle valve 1. The intake air G1 flowing into the surge tank 2 through the throttle valve 1 moves to the specific combustion chamber according to a pressure change occurring in the combustion chamber. Therefore, the EGR gas G2 is little mixed with the intake air G1 in the surge tank 2, and concentrates on the specific combustion chamber.

A vaporized gas generated in the fuel tank is collected in a canister, and then burned together with fuel to perform purging processing. When the vaporized gas is purged, the vaporized gas moves from the canister to the intake pipe. Accordingly, hydrocarbon is contained in the intake air. As described above, the hydrocarbon contained in the intake air is also easily mixed with the intake air in the surge tank when the opening amount of the throttle valve is small, but is not easily mixed with the intake air in the surge tank when the opening amount of the throttle valve is large. Therefore, when the opening amount of the throttle valve is large, a large amount of vaporized gas is introduced only into the specific combustion chamber.

The fuel is supplied to the intake air through the injector. The injector is mounted on either of the surge tank, the intake manifold, and the combustion chamber. The injector is designed to have a constant injection pressure. To supply a predetermined amount to intake air, operation timing and an operation time of the injector are adjusted. The operation timing and the operation time of the injector are adjusted so that the combustion in the combustion chamber may be completely burned according to signals obtained by various sensors mounted on the vehicle.

However, as described above, when the EGR gas or the vaporized gas flows into the intake pipe, the EGR gas or the vaporized gas concentrates only on the specific combustion chamber depending on the opening amount of the throttle valve. The adjustment of the operation timing and the operation time of the conventional injector do not take into account the concentration of the EGR gas or the vaporized gas. Therefore, it was not possible to prevent incomplete combustion from occurring in the specific combustion chamber due to a large or small fuel amount relative to oxygen.

The information included in this Background of the present invention section is only for enhancement of understanding of the general background of the present invention and may not be taken as an acknowledgement or any form of suggestion that this information forms the prior art already known to a person skilled in the art.

BRIEF SUMMARY

Various aspects of the present invention are directed to providing a method of compensating fuel for each cylinder of an engine during purging configured for maintaining a proper level of fuel relative to oxygen in a specific combustion chamber even if a vaporized gas is injected into an intake air to induce complete combustion.

To achieve the above-described object, according to an exemplary embodiment of the present invention, there is provided a method of compensating fuel for each cylinder of an engine during purging, including: compensating a fuel injection time for each cylinder depending on an amount of intake air for each cylinder, an injection pressure of the injector, and an internal pressure of a combustion chamber of the engine; pressurizing a vaporized gas adsorbed into a canister and injecting the pressurized vaporized gas into the intake pipe by operating an active purge pump; and estimating an amount of vaporized gas reaching each combustion chamber and converting the fuel injection time depending on the estimated amount of vaporized gas.

In the compensating of the fuel injection time for each cylinder, a fuel compressive force of the pump may be changed depending on a temperature of the fuel existing in a pump compressing the fuel.

In the pressurizing of the vaporized gas and injecting the pressurized vaporized gas into the intake pipe, a correction factor for measuring a total fuel amount supplied to the combustion chamber by injecting the fuel plural times may be changed depending on the internal pressure of the combustion chamber and a temperature of fuel existing in the pump compressing the fuel, and the fuel compressive force of the pump may be changed depending on the measured amount of the total fuel.

The amount of the vaporized gas may be estimated by combining the number of revolutions of the active purge pump, an opening and closing timing and an opening amount of a Purge Control Solenoid Valve (PCSV), and opening and closing timing of an intake valve and an exhaust valve of the engine.

An amount of EGR gas reaching each combustion chamber among EGR gases circulated to the intake pipe may be estimated, and the fuel injection time for each cylinder may be compensated or converted depending on the estimated amount of the EGR gas.

The fuel injection time for each cylinder may be converted by additionally applying the estimated amount of the vaporized gas, the changed correction factor, and the changed fuel compressive force of the pump to a map in which the fuel injection time for each cylinder has been modeled.

A mode value designated for each current operation mode may be additionally applied to the map correction in which the fuel injection time for each cylinder is modeled.

Opening and closing of an intake valve and an exhaust valve of the engine for each cylinder may be delayed or perceived so that a vibration of an engine or a pulsation of the intake valve and the exhaust valve is compensated for each operating region.

The active purge pump may be mounted on a purge line connecting between the canister and the intake pipe, the PCSV may be mounted on the purge line to be positioned between the active purge pump and the intake pipe, and a pressure sensor may be mounted on the purge line to be positioned between the active purge pump and the PCSV.

To achieve the above-described object, according to various exemplary embodiments of the present invention, there is provided a method of compensating fuel for each cylinder of an engine during purging, including: measuring a pressure of an intake air flowing into each cylinder through an intake manifold and determining an amount of intake air for each cylinder from a pressure of the intake air introduced into each cylinder; setting a target purge amount depending on a total amount of vaporized gas adsorbed into a canister and determining the number of revolutions of an active purge pump and an opening timing and an opening amount of a PCSV which satisfy the target purge amount; estimating an amount of vaporized gas to be introduced into each cylinder and the air amount when the target purge amount is satisfied; and correcting a fuel amount supplied to each cylinder in consideration of the amount of vaporized gas and the air amount to be introduced into each cylinder when the amount of intake air for each cylinder and the target purge amount are satisfied.

In the correcting of the fuel amount supplied to each cylinder, the fuel amount supplied to each cylinder may be corrected in additional consideration of a running air temperature, an running altitude, and a concentration of vaporized gas concentrated at a front end portion of the PCSV by the active purge pump before the PCSV is open to satisfy the target purge amount.

In the correcting of the fuel amount supplied to each cylinder, the running air temperature, the running altitude, the concentration of the vaporized gas concentrated at the front end portion of the PCSV by the active purge pump before the PCSV is open to satisfy the target purge amount and the corrected fuel amount supplied to each cylinder are recorded.

According to the method of compensating fuel for each cylinder of an engine during purging in accordance with the exemplary embodiment of the present invention configured as described above, the fuel injection time is corrected by determining the fuel injection time for each cylinder by the injector and then estimating the amount of vaporized gas introduced into each combustion chamber, so that the possibility of occurrence of the rich combustion by the vaporized gas is reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
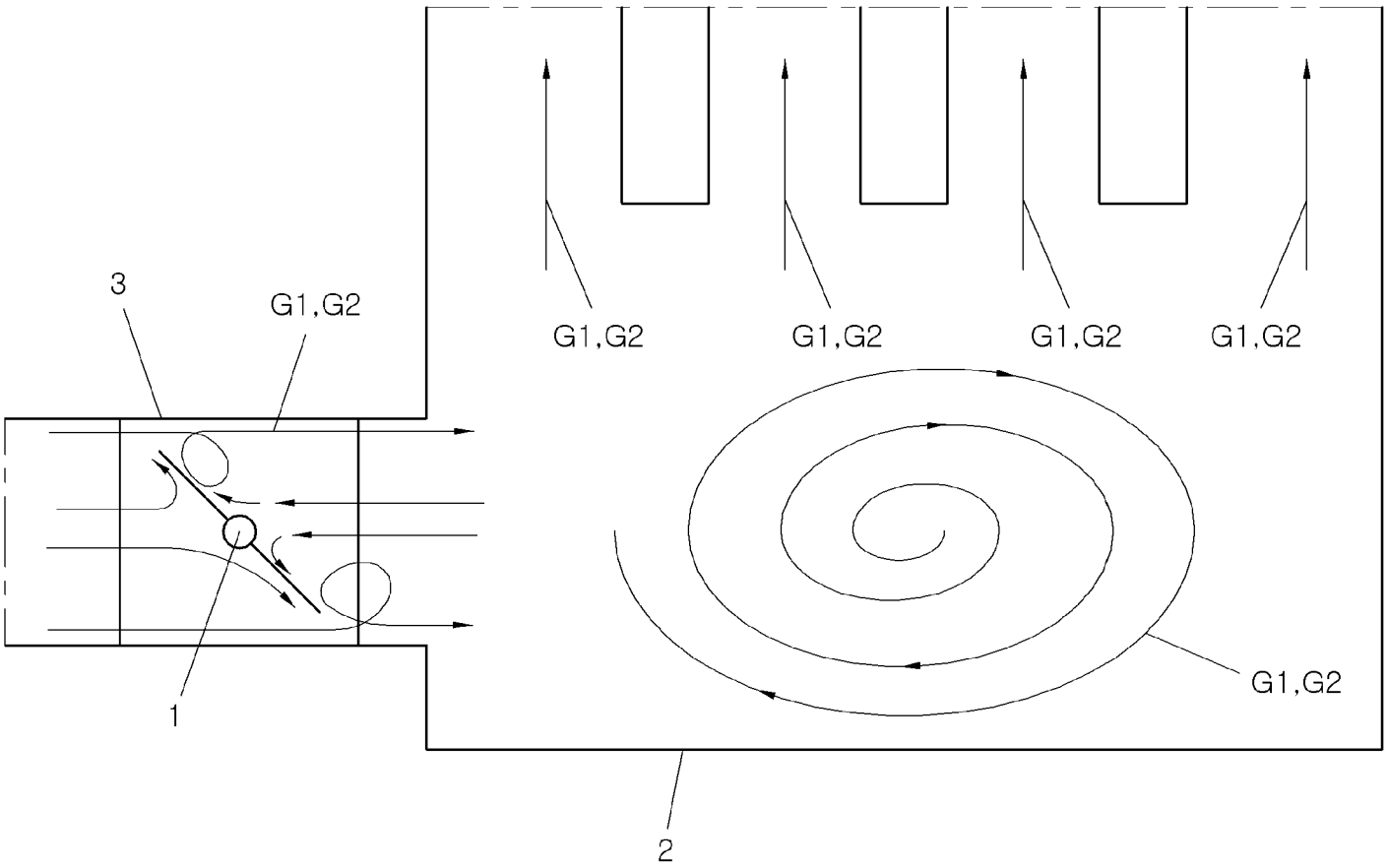
FIG. 1 and FIG. 2 are exemplary cross-sectional views of the existing throttle valve and surge tank.
Figure 2:
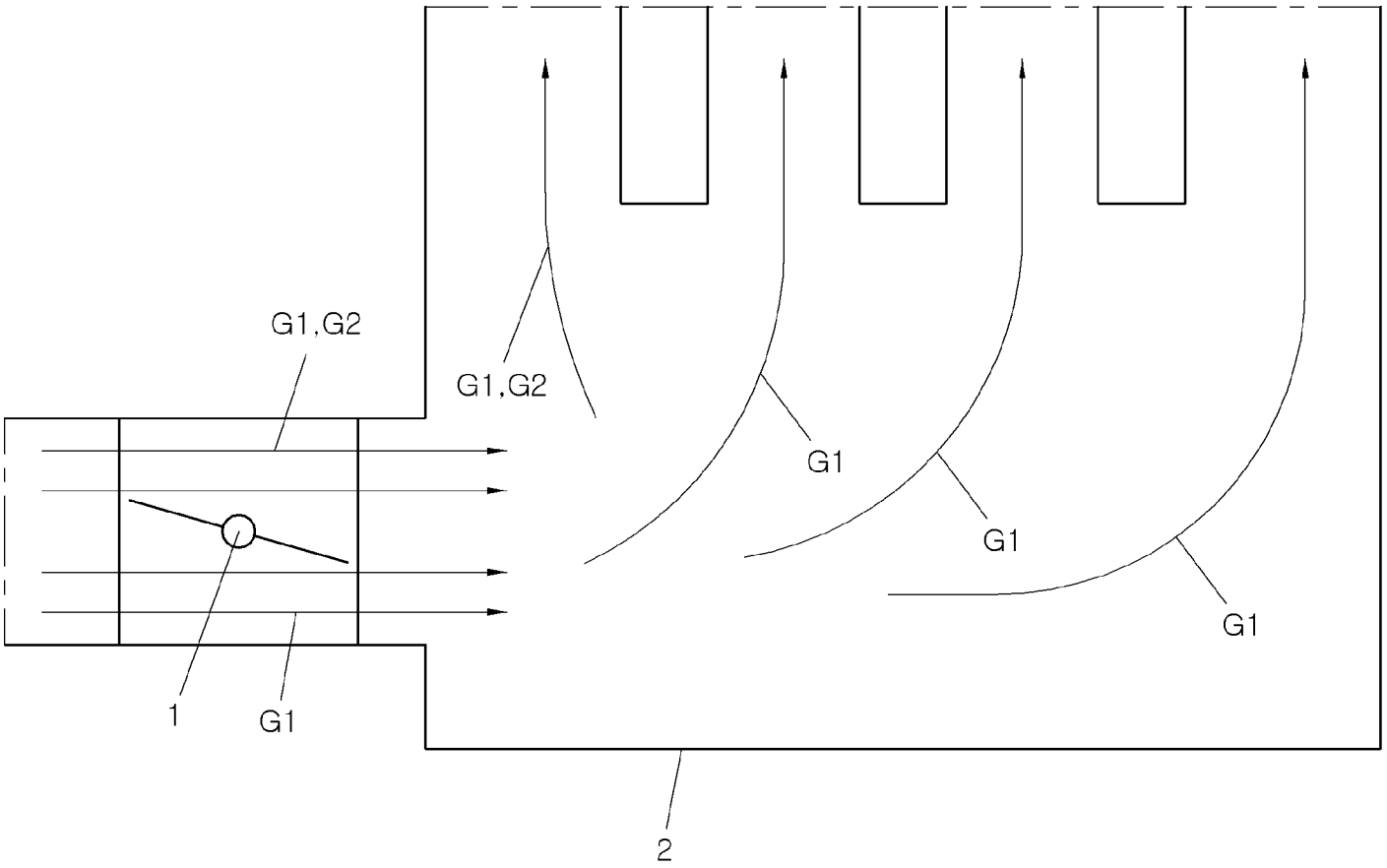

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other h, and the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, a method of compensating fuel for each cylinder of an engine during purging according to an exemplary embodiment of the present invention will be described with reference to the accompanying drawings. The method of compensating fuel for each cylinder of an engine during purging according to the exemplary embodiment of the present invention is implemented by a control unit mounted on a vehicle. The control unit receives signals from various sensors mounted on the vehicle. The control unit derives variables from the received signals, substitutes the derived variables into stored programs, equations, and maps to derive required result values in each step. The control unit operates each device through the derived result values.

Figure 3:
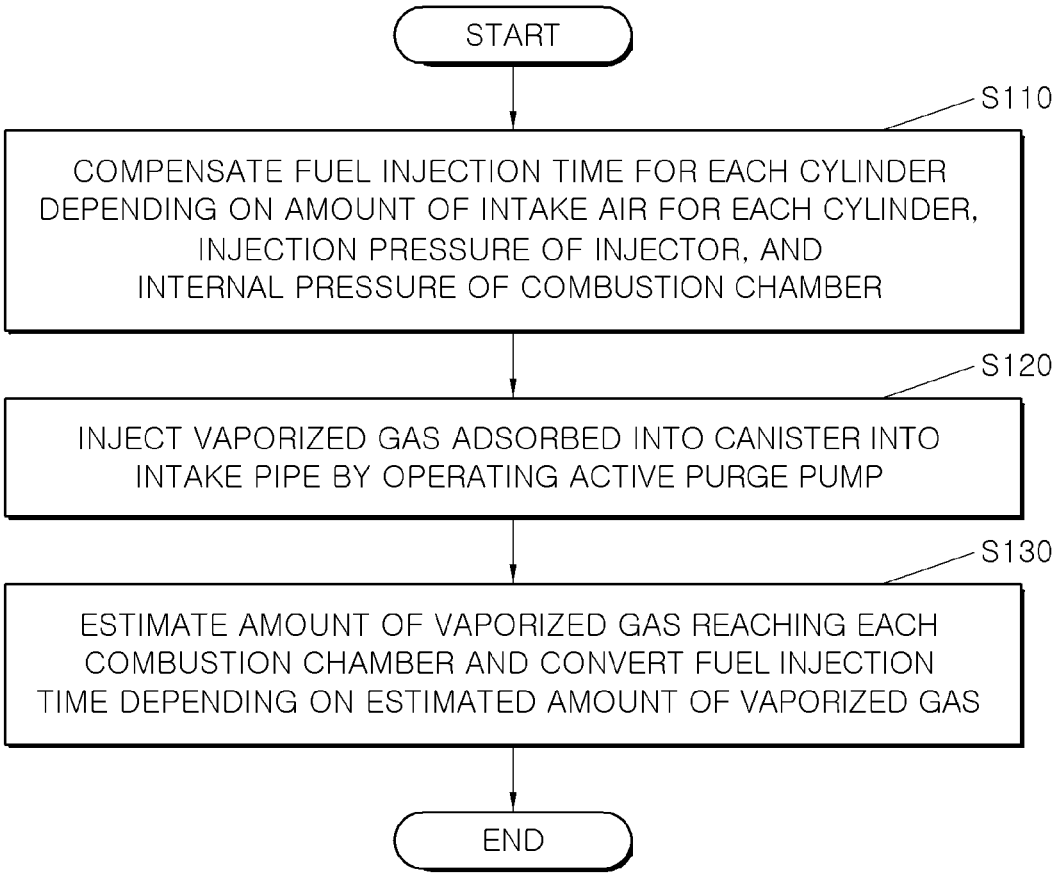
FIG. 3 is a flow chart of a method of compensating fuel for each cylinder of an engine during purging according to an exemplary embodiment of the present invention.

As shown in FIG. 3, the method of compensating fuel for each cylinder of an engine during purging according to the exemplary embodiment of the present invention includes compensating a fuel injection time for each cylinder depending on an amount of intake air for each cylinder, an injection pressure of the injector 600, and an internal pressure of a combustion chamber of the engine R (S110), pressurizing a vaporized gas adsorbed into a canister 100 and injecting the pressurized vaporized gas into the intake pipe I by operating an active purge pump 300 (S120), and estimating an amount of vaporized gas reaching each combustion chamber R and converting the fuel injection time depending on the estimated amount of vaporized gas (S130).

In the compensating of the fuel injection time for each cylinder (S110), the fuel injection time of the injector 600 for each cylinder is determined so that a proper mixing ratio may be satisfied in the combustion chamber R based on the fuel amount supplied to the combustion chamber R per unit time and the air amount supplied to each cylinder according to the operation of the injector 600. The injector 600 is provided for each cylinder.

According to one example, a flow meter is mounted on an intake manifold M connected to each cylinder. Based on the signal generated by the flow meter, the internal pressure of the combustion chamber R is determined. The internal pressure of the combustion chamber R forms a reaction force against the fuel injected from the injector 600. The internal pressure of the combustion chamber R and the injection pressure of the injector 600 are determined to estimate the fuel amount injected per hour from the actual injector 600. The air amount supplied to each cylinder is determined based on the signal generated by the flow meter mounted on each intake manifold M.

Figure 4:
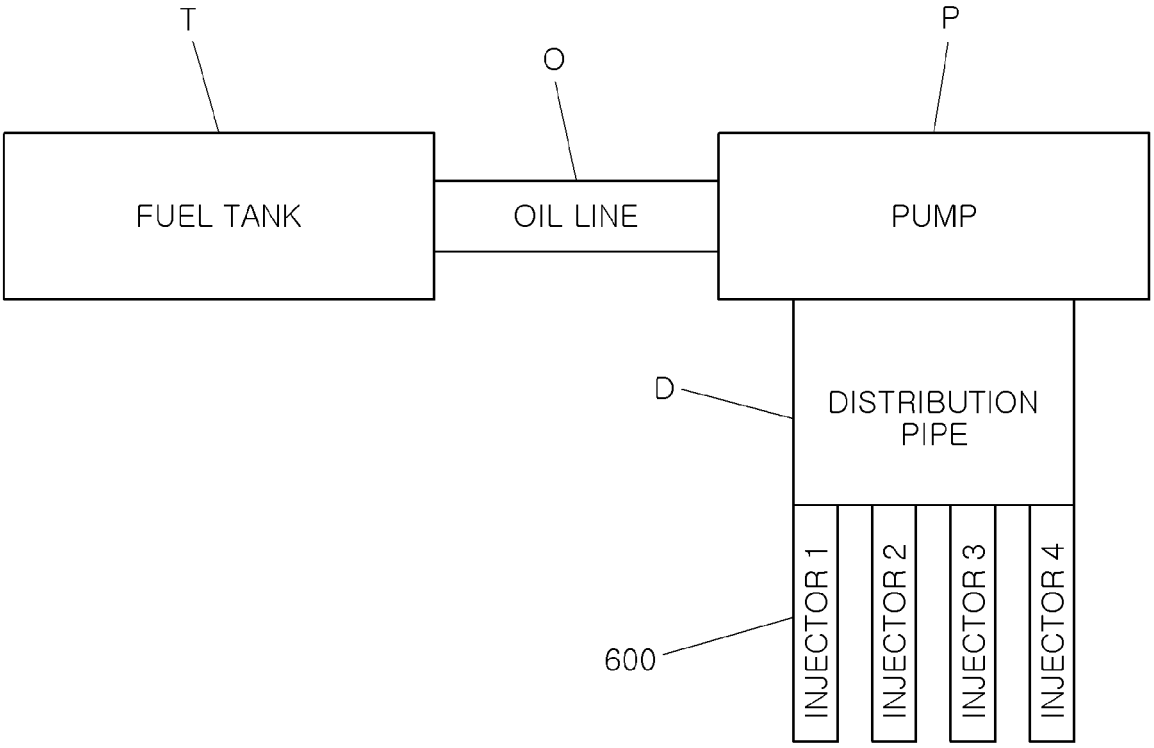
FIG. 4 is a block diagram showing a fuel supply system.

Furthermore, each injector 600 is supplied with pressurized fuel from a fuel supply system which compresses and supplies fuel as shown in FIG. 4. The fuel supply system has a low pressure area and a high pressure area. The low pressure area is a fuel tank T and an oil line O connecting between the fuel tank T and a pump P. The high pressure area is the pump P which compresses fuel and a distribution pipe D which accommodates fuel pressurized by the pump P and is connected to each injector 600. The high pressure area is very hot due to heat generated by the pump P operation.

Therefore, only when a sufficient pressure is applied to the oil line O, the fuel present in the oil line O can exist in a liquid state. In the compensating of the fuel injection time for each cylinder (S110), the fuel compressive force of the pump P is changed depending on the temperature of the fuel existing in the pump P which compresses fuel to keep the fuel existing in the oil line O in a liquid state.

In the pressurizing of the vaporized gas and injecting the pressurized vaporized gas into the intake pipe I (S120), a correction factor for measuring a total fuel amount supplied to the combustion chamber R by injecting fuel plural times is changed depending on the internal pressure of the combustion chamber R and the fuel temperature existing in the pump P which compresses fuel. At the same time, the fuel compressive force of the pump P is changed depending on the internal temperature of the pump P which compresses the fuel or the total fuel amount measured.

The fuel in the pressurized state existing in the distribution pipe D is injected into each combustion chamber R through the injector 600 when each injector 600 is operated. The pressure change may occur in the fuel existing in the distribution pipe D during the continuous multi-stage injection. The correction factor represents a pressure change rate of fuel passing through the injector 600 during the multi-stage injection.

In the converting of the fuel injection time (S130), the amount of vaporized gas is estimated by combining the number of revolutions of the active purge pump 300, an opening and closing timing and an opening amount of a PCSV 400, and an opening and closing timing of an intake valve and an exhaust valve of the engine.

The fuel injection time for each cylinder is converted by additionally applying the estimated amount of vaporized gas, the changed correction factor, and the changed fuel compressive force of the pump P to a map in which the fuel injection time for each cylinder has been modeled. Furthermore, a mode value designated for each current operation mode is additionally applied to the map in which the fuel injection time for each cylinder has been modeled.

Furthermore, vibration exceeding an appropriate range may be generated in the engine depending on the change in the fuel injection time. The amount of vaporized gas that has reached the combustion chamber R due to a pulsation generated in the intake valve and the exhaust valve may be different from the estimated amount of vaporized gas. Accordingly, the opening and closing of the intake valve and the exhaust valve for each cylinder are delayed or perceived so that the vibration of an engine or the pulsation of the intake valve and the exhaust valve is compensated for each operating region.

The operation mode includes a comfort mode, a sports mode, and an economical mode. The operation mode is selected by a driver. In the case of the economical mode, the fuel injection time by the injector 600 is relatively reduced as compared with the comfort mode and the sports mode so that lean combustion may occur. In the case of the sports mode, the fuel injection time by the injector 600 is increased as compared with the economical mode and the comfort mode so that rich combustion may occur but the engine may generate a high output. In the case of the comfort mode, the fuel injection time by the injector 600 is increased or decreased according to a running speed and an engine load.

Figure 5:
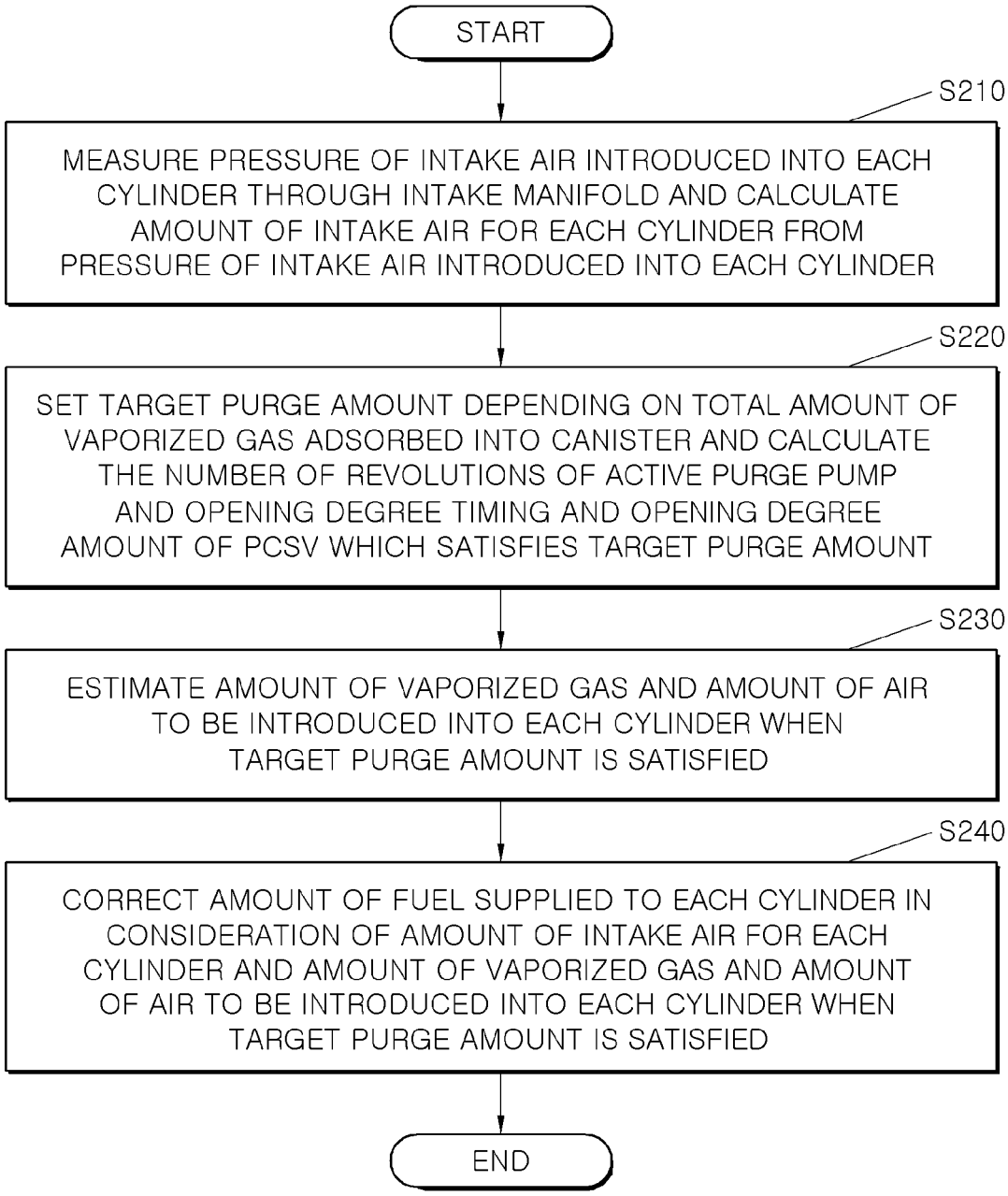
FIG. 5 is a flow chart of a method of compensating fuel for each cylinder of an engine during purging according to various exemplary embodiments of the present invention.

As shown in FIG. 5, a method of compensating fuel for each cylinder of an engine during purging according to various exemplary embodiments of the present invention includes measuring a pressure of an intake air flowing into each cylinder through an intake manifold and determining an amount of intake air for each cylinder from a pressure of the intake air introduced into each cylinder (S210), setting a target purge amount depending on a total amount of vaporized gas adsorbed into a canister 100 and determining the number of revolutions of an active purge pump 300 and an opening amount timing and an opening amount of a PCSV 400 which can satisfy the target purge amount (S220), estimating an amount of vaporized gas to be introduced into each cylinder and the air amount when the target purge amount is satisfied (S230), and correcting the amount of intake air for each cylinder and a fuel amount supplied to each cylinder in consideration of the amount of vaporized gas and the air amount to be introduced into each cylinder when the target purge amount may be satisfied (S240).

In the determining of the amount of intake air for each cylinder (S210), an internal pressure of a combustion chamber of the engine R is determined according to a signal generated in a flow meter. According to one example, a flow meter is mounted on an intake manifold M connected to each cylinder. The internal pressure of the combustion chamber R forms a reaction force against the fuel injected from the injector 600. The internal pressure of the combustion chamber R and the injection pressure of the injector 600 are determined to estimate the fuel amount injected per hour from the actual injector 600. The air amount supplied to each cylinder is determined based on the signal generated by the flow meter mounted on each intake manifold M.

In the determining of the number of revolutions of the active purge pump 300 and the opening timing and the opening amount of the PCSV 400 (S220), the target purge amount is set depending on a total amount of vaporized gas adsorbed into the canister 100. A vehicle speed and an engine load are taken into account in setting the target purge amount. The number of revolutions of the active purge pump 300 and the opening timing and the opening amount of the PCSV 400 in which the target purge amount may be satisfied are determined.

In the estimating of the amount of vaporized gas and the air amount to be introduced into each cylinder (S230), a difference in pressure between front and rear end portions of the active purge pump 300 is derived based on the number of revolutions of the active purge pump 300. The amount of vaporized gas and the air amount flowing into the intake pipe from the PCSV 400 are determined by use of the opening timing and the opening amount of the PCSV 400 as variables. The concentration of the vaporized gas compressed between the active purge pump 300 and the PCSV 400 is predicted from the difference in pressure between the front and rear end portions of the active purge pump 300.

In the correcting of the fuel amount supplied to each cylinder (S240), when the amount of intake air and the target purge amount for each cylinder are satisfied, the fuel amount supplied to each cylinder is corrected in consideration of the amount of vaporized gas to be introduced and the air amount into each cylinder.

A map in which an appropriate fuel amount is supplied depending on the amount of intake air and the engine load is prepared. As variables for the map correction, the amount of vaporized gas and the air amount to be introduced into each cylinder are applied when the amount of intake air and the target purge amount for each cylinder are satisfied.

In the correcting of the fuel amount supplied to each cylinder (S240), the fuel amount supplied to each cylinder is corrected in additional consideration of a running air temperature, an running altitude, and a concentration of vaporized gas concentrated at a front end portion of the PCSV 400 in addition to the amount of intake air, the amount of vaporized gas, and the air amount for each cylinder.

At the present time, the running air temperature, the running altitude, the concentration of the vaporized gas concentrated at the front end portion of the PCSV 400, and the corrected fuel amount supplied to each cylinder are recorded per unit time as learning variables.

Figure 6:
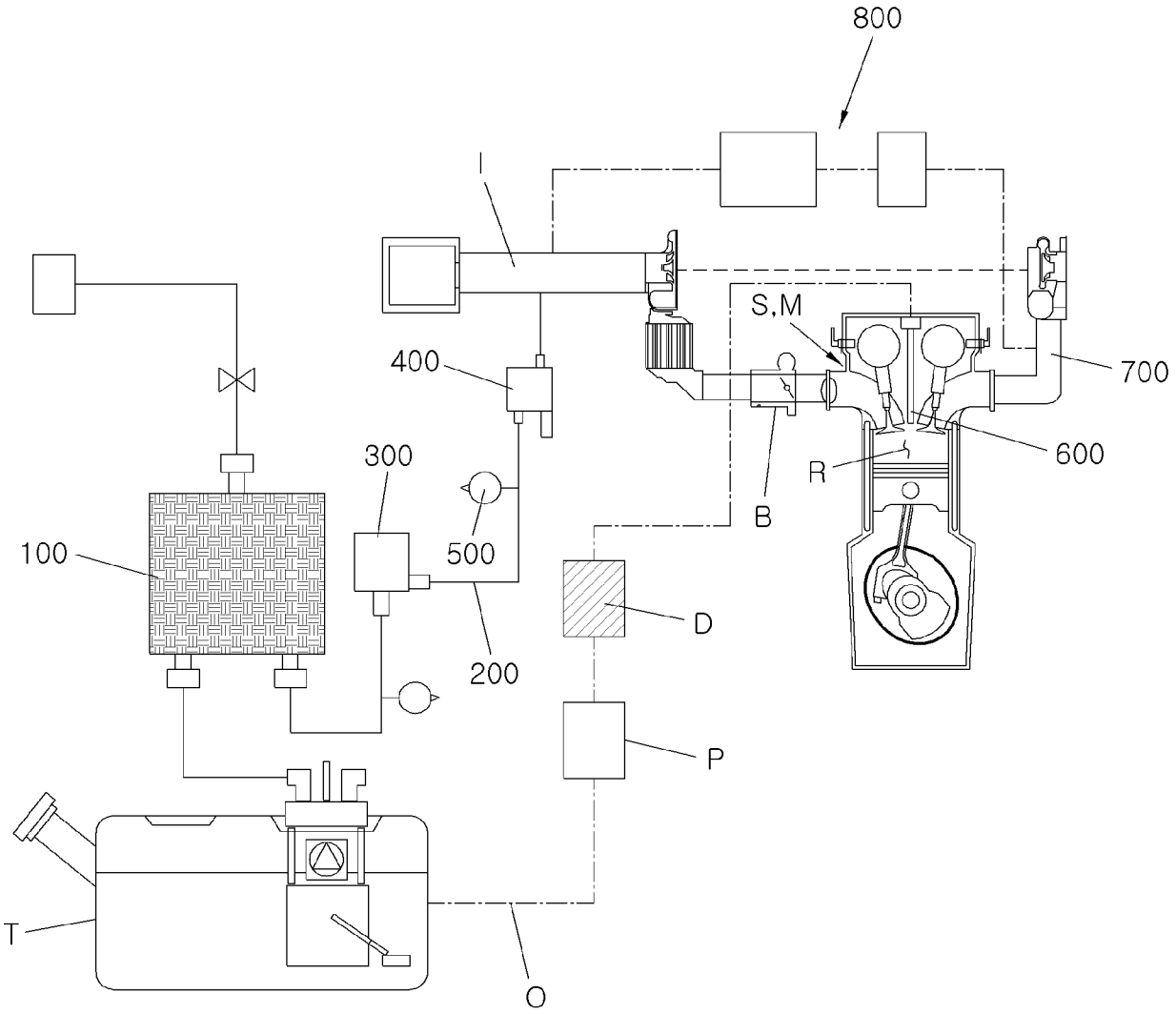
FIG. 6 is an exemplary diagram of a system of compensating fuel for each cylinder of an engine during purging according to an exemplary embodiment of the present invention.

As shown in FIG. 6, a system of compensating fuel for each cylinder of an engine during purging according to an exemplary embodiment of the present invention includes a canister 100 connected to a fuel tank T to adsorb vaporized gas, a purge line 200 connecting between the canister 100 and an intake pipe I, an active purge pump 300 mounted on the purge line 200, a PCSV 400 mounted on the purge line 200 to be positioned between the intake pipe I and the active purge pump 300, a plurality of pressure sensors 500 mounted on the purge line 200 to be positioned between the active purge pump 300 and the PCSV 400 and between the canister 100 and the active purge pump 300, respectively, a plurality of injectors 600 injecting fuel into each combustion chamber R connected to the intake pipe I, an exhaust pipe 700 connected to the combustion chamber R, an EGR device 800 circulating an exhaust gas from an exhaust pipe 700 to an intake pipe I, and a throttle body B mounted on a connection portion between the intake pipe I and a surge tank S.

By operating the active purge pump 300, the vaporized gas may be compressed in a section between the active purge pump 300 and the PCSV 400 in the purge line 200. The concentration of the vaporized gas collected in the section between the active purge pump 300 and the PCSV 400 is adjusted by adjusting the number of revolutions of the active purge pump 300. The amount of vaporized gas introduced into the intake pipe I from the purge line 200 may be adjusted by adjusting the opening and closing timing and the opening amount of the PCSV 400. A density is determined based on the concentration of the vaporized gas. The fuel injection amount may be adjusted based on the determined density of the vaporized gas.

The amount of vaporized gas reaching each combustion chamber R may be estimated based on the number of revolutions of the active purge pump 300, the opening and closing timing and the opening amount of the PCSV 400, and the opening and closing timing of the intake valve and the exhaust valve. The amount of EGR gas that has reached each combustion chamber R among the EGR gases circulated to the intake pipe I by the operation of the EGR apparatus 800 may be estimated. The fuel injection time for each cylinder may be compensated or converted depending on the estimated amount of EGR gas.

According to the method of compensating fuel for each cylinder of an engine during purging in accordance with the exemplary embodiment of the present invention configured as described above, the fuel injection time is corrected by determining the fuel injection time for each cylinder by the injector 600 and then estimating the amount of vaporized gas introduced into each combustion chamber R, so that the possibility of occurrence of the rich combustion by the vaporized gas is reduced.

In an exemplary embodiment of the present invention, a controller is connected to at least one of the elements of the fuel supply system, to control the operations thereof.

In addition, the term "controller" refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention.

The controller may be at least one microprocessor operated by a predetermined program which may include a series of commands for carrying out a method in accordance with various exemplary embodiments of the present invention.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of compensating fuel for each cylinder of an engine during purging, the method comprising:

compensating a fuel injection time for each cylinder depending on an amount of intake air for each cylinder, an injection pressure of an injector detected by a pressure sensor on a fuel rail, and an internal pressure of a combustion chamber of the engine;

pressurizing a vaporized gas adsorbed into a canister and injecting the pressurized vaporized gas into an intake pipe by operating a purge pump; and estimating an amount of vaporized gas reaching each combustion chamber and adjusting the fuel injection time depending on the estimated amount of the vaporized gas, wherein in the pressurizing of the vaporized gas and injecting the pressurized vaporized gas into the intake pipe, a correction factor for measuring a total amount of fuel supplied to the combustion chamber by injecting the fuel in a plurality of times is changed depending on the internal pressure of the combustion chamber and a temperature of fuel existing in a pump compressing the fuel, and a fuel compressive force of the pump is changed depending on the measured total amount of the fuel.

2. The method of claim 1, wherein in the compensating of the fuel injection time for each cylinder, the fuel compressive force of the pump is changed depending on the temperature of the fuel existing in the pump compressing the fuel.

3. The method of claim 1, wherein the amount of the vaporized gas is estimated by combining a number of revolutions of the purge pump, an opening and closing timing and an opening amount of a Purge Control Solenoid Valve (PCSV), and opening and closing timing of an intake valve and an exhaust valve of the engine.

4. The method of claim 3, wherein an amount of exhaust gas recirculation (EGR) gas reaching each combustion chamber among EGR gases circulated to the intake pipe is estimated, and the fuel injection time for each cylinder is compensated or adjusted depending on the estimated amount of the EGR gas.

5. The method of claim 1, wherein the fuel injection time for each cylinder is adjusted by applying the estimated amount of the vaporized gas, the changed correction factor, and the changed fuel compressive force of the pump to a map in which the fuel injection time for each cylinder has been modeled.

6. The method of claim 5, wherein a mode value designated for each current operation mode is applied to correct the map in which the fuel injection time for each cylinder has been modeled.

7. The method of claim 5, wherein opening and closing of an intake valve and an exhaust valve for each cylinder is delayed or perceived so that a vibration of the engine or a pulsation of the intake valve and the exhaust valve is compensated for each operating region.

8. The method of claim 1, wherein the purge pump is mounted on a purge line connecting between the canister and the intake pipe, a PCSV is mounted on the purge line to be positioned between the purge pump and the intake pipe, and a pressure sensor is mounted on the purge line to be positioned between the purge pump and the PCSV.

9. A method of compensating fuel for each cylinder of an engine during purging, the method comprising:

measuring a pressure of an intake air flowing into each cylinder through an intake manifold of the engine and determining an amount of intake air for each cylinder from a pressure of the intake air introduced into each cylinder;

setting a target purge amount depending on a total amount of vaporized gas adsorbed into a canister and determining a number of revolutions of a purge pump and an opening timing and an opening amount of a Purge Control Solenoid Valve (PCSV) which satisfy the target purge amount;

estimating an amount of vaporized gas and an amount of air to be introduced into each cylinder upon determining that the target purge amount is satisfied; and correcting a fuel amount supplied to each cylinder in consideration of the amount of vaporized gas and the amount of air to be introduced into each cylinder upon determining that the amount of intake air for each cylinder and the target purge amount are satisfied.

10. The method of claim 9, wherein in the correcting of the fuel amount supplied to each cylinder, the fuel amount supplied to each cylinder is corrected in consideration of a running air temperature, a running altitude, and a concentration of vaporized gas concentrated at a front end portion of the PCSV by the purge pump before the PCSV is opened to satisfy the target purge amount.

11. The method of claim 10, wherein in the correcting of the fuel amount supplied to each cylinder, the running air temperature, the running altitude, the concentration of the vaporized gas concentrated at the front end portion of the PCSV by the purge pump before the PCSV is opened to satisfy the target purge amount and the corrected fuel amount supplied to each cylinder are recorded.

12. The method of claim 9, wherein the purge pump is mounted on a purge line connecting between the canister and an intake pipe, the PCSV is mounted on the purge line to be positioned between the purge pump and the intake pipe, and a pressure sensor is mounted on the purge line to be positioned between the purge pump and the PCSV.

* * * * *